US005431362A

United States Patent [19]

Carnahan et al.

[11] Patent Number: 5,431,362

[45] Date of Patent: Jul. 11, 1995

[54] ADJUSTABLE AND TRANSFORMABLE FIXTURE SUPPORT APPARATUS

[75] Inventors: Garnett H. Carnahan; Ronald W. Mawhiney, both of Nixa, Mo.

[73] Assignee: Springfield Aluminum Company, Inc., Nixa, Mo.

[21] Appl. No.: 117,734

[22] Filed: Sep. 7, 1993

[51] Int. Cl.[6] ..... F16M 13/00

[52] U.S. Cl. ..... 248/159; 297/344.22; 297/344.26

[58] Field of Search ..... 248/158, 159, 131, 415, 248/418; 297/344.22, 344.26; 114/363

[56] References Cited

U.S. PATENT DOCUMENTS

| | | | |
|---|---|---|---|
| 2,529,780 | 11/1950 | Miller | 248/159 X |
| 4,566,734 | 1/1986 | Bruner | 297/344.26 X |
| 4,587,921 | 5/1986 | Currey | 248/158 X |
| 4,928,620 | 5/1990 | Currey | 114/363 |
| 5,329,871 | 7/1994 | Gibbs | 114/363 |

FOREIGN PATENT DOCUMENTS

| | | | |
|---|---|---|---|
| 0168984 | 9/1934 | Switzerland | 297/344.26 |

*Primary Examiner*—Ramon O. Ramirez

*Attorney, Agent, or Firm*—Armstrong, Teasdale, Schlafly & Davis

[57] ABSTRACT

An adjustable and transformable fixture support apparatus for mountably supporting a fixture such as a boat seat, the support system including a swivel, a pedestal and a support anchor, the swivel having one end formed to permit mounting the fixture thereto and an opposing end forming a stem, the pedestal having one end forming a stem and an opposing end formed to receive the stem of the swivel so as to releasably retain the swivel against longitudinal displacement while adjustably retaining the swivel in a plurality of radial orientations, and the support anchor being formed to receive the stem of the swivel and alternatively the stem of the pedestal so as to releasably retain the respective stem against longitudinal displacement while adjustably retaining the respective stem in a plurality of radial orientations.

12 Claims, 6 Drawing Sheets

ADJUSTABLE AND TRANSFORMABLE FIXTURE SUPPORT APPARATUS

BACKGROUND OF THE INVENTION

1. Technical Field

The present invention relates to a fixture support apparatus for supporting a variety of fixtures such as boat seats, tables and barbecue grills, and, more particularly, to an adjustable and transformable fixture support system which includes a swivel having one end formed to fixedly receive the desired fixture and an opposing end forming a stem, a pedestal having one end forming a stem and an opposing end formed to receive the stem of the swivel to releasably retain the swivel against longitudinal displacement while adjustably retaining the swivel in a plurality of radial orientations, and a support anchor being formed to receive the stem of the swivel or alternatively the stem of the pedestal to releasably retain the respective stem against longitudinal displacement while adjustably retaining the respective stem in a plurality of radial orientations.

2. Background Art

It is well known in the recreational vehicle industry, the customized van industry, the boat industry and others to provide multi-functional support mechanisms to which a variety of fixtures such as boat seats, recreational vehicle seats, patio and deck seats, coolers, tables, and barbecue grills can be attached. Support mechanisms well known in the field provide a variety of combinations of functions. However, no known prior art support mechanism has been developed that simultaneously provides the following combination of functions: means for readily attaching a swivel, to which a fixture may be attached, to a pedestal of the support apparatus and, alternatively, to a base or support anchor of the apparatus; means for permitting the swivel to be swivelled while retained on the pedestal and, alternatively, the base; means for preventing the swivel from being swivelled while retained by the pedestal and, alternatively, the support anchor; means for readily detaching the swivel from the respective pedestal or base and easily reattaching the swivel to the original, or other, pedestal or base; and means for readily detaching the pedestal from the support anchor and easily reattaching the pedestal to the original, or other, support anchor.

Furthermore, safety standards have been developed, particularly for boat seats, which require fixture support mechanisms, whether single- or multi-functional, to be capable of resisting up to 150 foot pounds or more of torc. No prior art multi-functional support mechanisms are known to meet this safety standard. And of course, even in circumstances where safety requirements have not been imposed, it is still advantageous and desirable to provide a fixture support apparatus that will safely and securely support the fixture affixed thereto while simultaneously providing various functions desirable to that application.

There is, therefore, a need for a multi-functional fixture support apparatus that meets or exceeds all applicable safety standards while providing greater versatility and convenience than is available in prior art fixture support mechanisms.

SUMMARY OF THE INVENTION

The above and other improvements to prior art fixture support devices are provided by the present invention, which includes a three-section fixture support apparatus. The first section includes a swivel having one end formed to permit a fixture to be attached thereto and an opposing end forming a stem including mechanically adjustable means controlled by a two-position hand lever in communication therewith. The second section includes a pedestal having one end forming a stem including mechanically adjustable means controlled by a two-position hand lever in communication therewith. The opposing end of the pedestal is formed to fully receive the stem of the swivel and permit unobstructed radial displacement of the swivel when the two-position hand lever of the swivel is in its first position. The opposing end of the pedestal is further formed to releasably retain the swivel against longitudinal displacement while adjustably retaining the swivel in one of a plurality of radial orientations when the two-position hand lever of the swivel is in its second position. The third section includes a support anchor or base being formed to fully receive, and permit unobstructed radial displacement of, the stem of the swivel and, alternatively, the stem of the pedestal when the respective two-position hand lever is in its first position, and to releasably retain the respective stem against longitudinal displacement while adjustably retaining the respective stem in one of a plurality of radial orientations when the corresponding two-position hand lever is in its second position.

It should be noted that the two-position hand levers of the swivel and of the pedestal are normally retained in their respective second positions by a spring bias associated with each. Only by applying pressure against a given hand lever sufficient to overcome the bias of the corresponding spring can that hand lever be moved from its second position into its first position.

In an alternate embodiment of the present invention, mechanical means are included for retaining the hand lever of the swivel in its first position, thereby permitting unobstructed rotation of the swivel while leaving a user's hands free of the two-position lever associated therewith.

It can, therefore, be understood that the device of the present invention enables a fixture attached to or mounted on the swivel to be retainably adjusted in a predetermined variety of radial increments and, alternatively, to rotate freely whether the fixture support apparatus is configured with the pedestal connected between the swivel and the support anchor, or whether the fixture support apparatus is transformed to have the pedestal removed and the swivel connected directly to the base.

It is therefore a principal object of the present invention to teach the construction and operation of a multi-functional fixture support apparatus providing improved versatility and convenience.

It is another object to provide a multi-functional fixture support mechanism yielding greater adjustability.

It is another object to provide a multi-functional fixture support mechanism having improved transformability.

It is a further object to provide a multi-functional fixture support apparatus that exceeds all applicable safety standards.

It is yet another object to provide a multi-functional fixture support apparatus that is more easily adjusted.

It is still a further object to provide a multi-functional fixture support mechanism that alternatively permits unobstructed fixture rotation and controlled fixture rotation.

It is another object to provide a multi-functional fixture support apparatus having improved stability.

These and other objects and advantages of the present invention will become more apparent to those skilled in the art after consideration of the following specification taken in conjunction with the accompanying drawings wherein similar characters of reference refer to similar structures in each of the separate views.

BRIEF DESCRIPTION OF THE DRAWINGS

In the drawings that illustrate preferred embodiments of the invention.

DETAILED DESCRIPTION OF THE INVENTION

Figure 1:
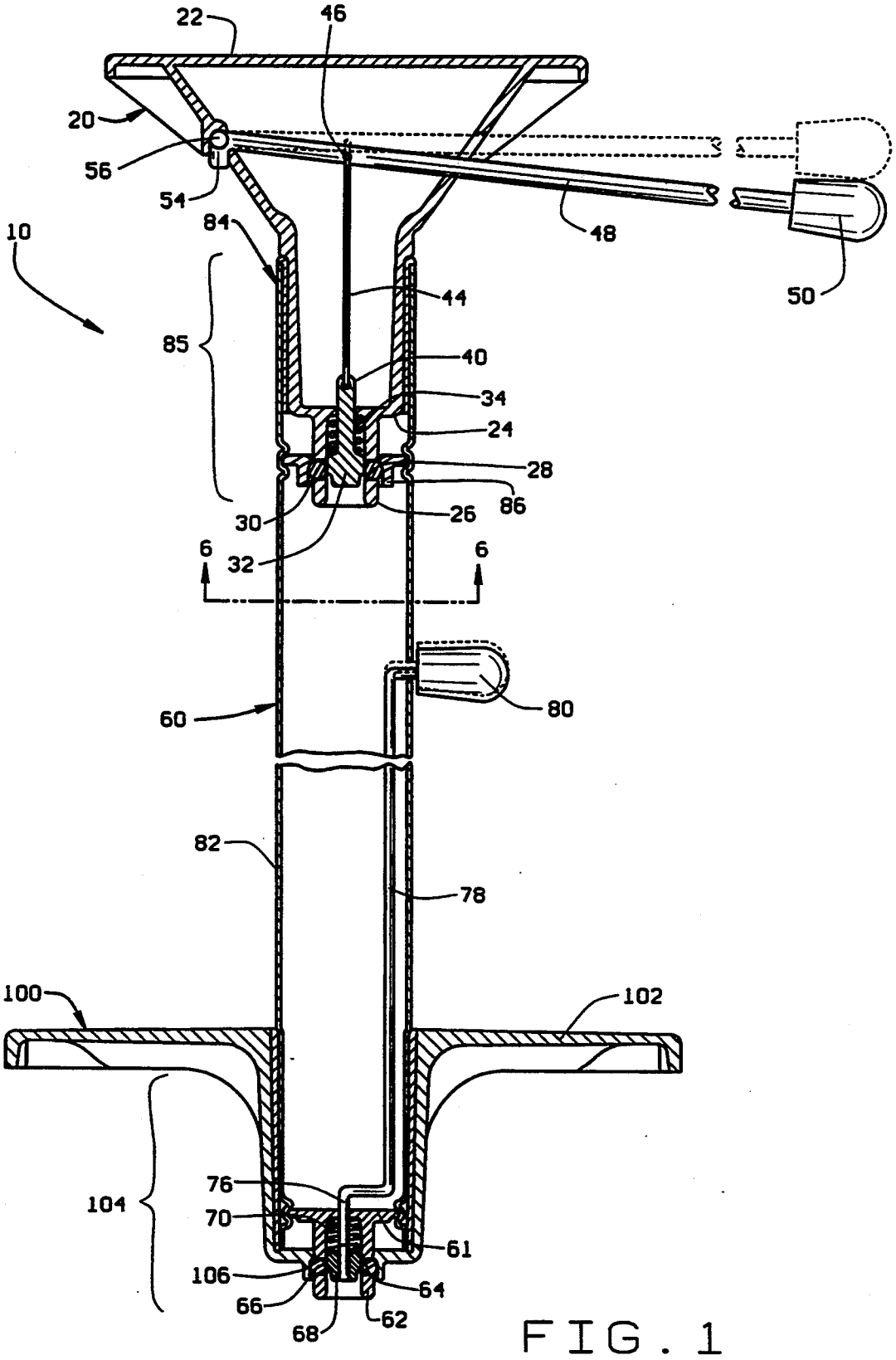
FIG. 1 is a broken cross-sectional elevational view of a multi-functional fixture support apparatus constructed according to the teachings of the present invention in a first configuration having the pedestal connected between the swivel and the support anchor.
Figure 6:
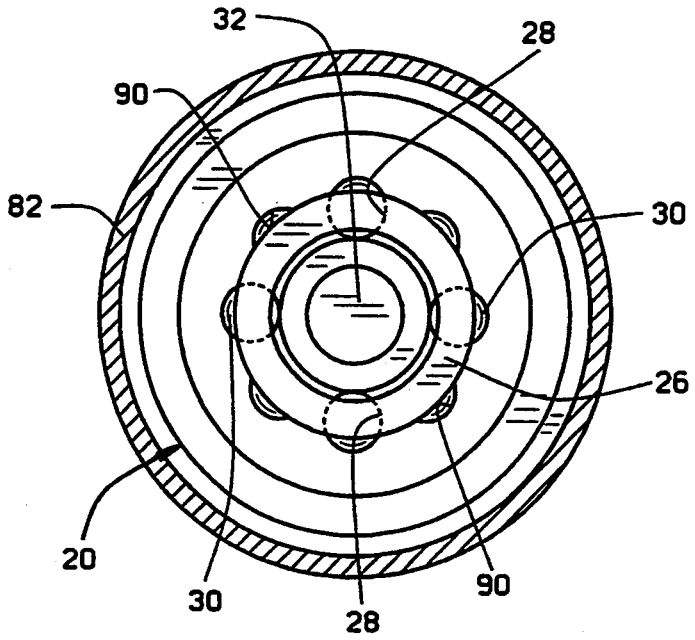
FIG. 6 is an enlarged cross-sectional view taken along line 6—6 of FIG. 1.

Referring to the drawings more particularly by reference numbers wherein like numerals refer to like parts, number 10 in FIG. 1 identifies a multi-functional fixture support apparatus including a swivel 20 having one end 22 formed to enable a fixture (see FIGS. 2 and 3) to be mounted thereto. The opposing end of the swivel 20 forms a stem 24 including an annular wall 26 having a plurality of apertures 28, each aperture 28 being equally spaced from each adjacent aperture 28 and housing a corresponding ball bearing 30, (see FIG. 6). In the preferred embodiment, the annular wall 26 includes four apertures 28. A detent 32 spaced inwardly from the annular wall 26 is positioned within the swivel 20 for reciprocating movement along a longitudinal axis of the swivel 20.

Figure 4:
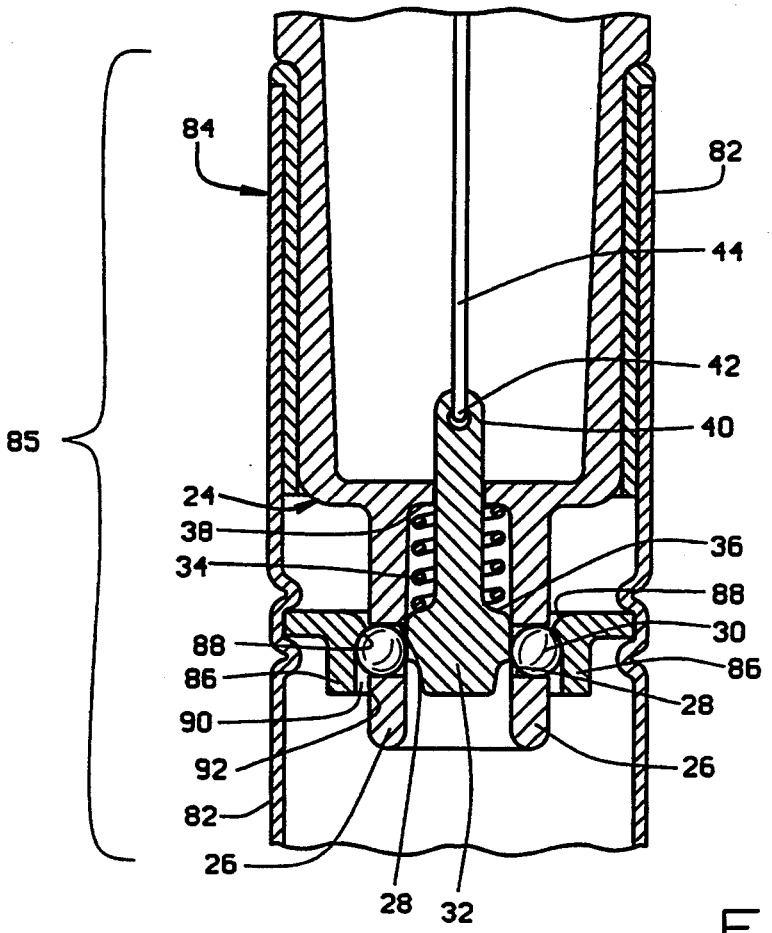
FIG. 4 is an enlarged axial cross-sectional view taken along line 4—4 of FIG. 2 when the hand lever of the swivel is in its second position.

As can be better seen in FIG. 4, a spring 34 mounted between a shoulder 36 formed in the detent 32 and a shoulder 38 formed in the annular wall 26 biases the detent 32 downwardly toward the ball bearings 30. The end 40 of the detent 32 that is distal from the ball bearings 30 is connected to one end 42 of a rod 44. The opposing end 46 of the rod 44 is connected to a lever arm 48. One end 50 of the lever arm 48 passes through an aperture 52 (see FIG. 8), while the opposing end 54 of the lever arm 48 is pivotally housed in the swivel 20. Therefore, the lever arm 48 can be moved between a first position (shown in FIG. 1 in dotted lines) and a second position (shown in FIG. 1 in bold lines).

Figure 5:
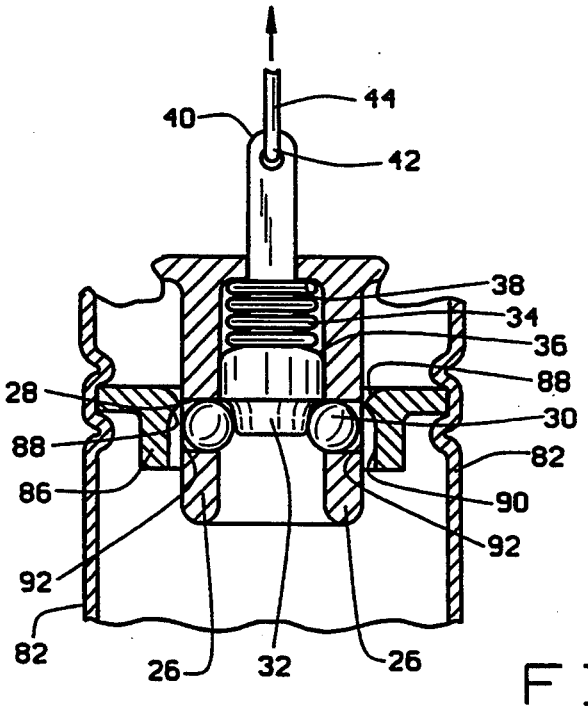
FIG. 5 is a partial cross-sectional view of FIG. 4 taken along line 4—4 of FIG. 2 when the swivel hand lever is in its first position.

Under normal operating circumstances, the bias of the spring 34 forces the detent 32 into contact with the ball bearings 30, thereby causing the ball bearings 30 to be locked in their outward-most position within the annular wall 26 while forcing the lever arm 48 into its second position. Upon applying adequate pressure to one end 50 of the lever arm 48 to overcome the bias of the spring 34, the lever arm 48 will pivot about its opposing end 54 and move into its first position. In so doing, the lever arm 48 will apply a pulling force to the rod 44 which will, in turn, pull the detent 32 away from the ball bearings 30. This will enable the ball bearings 30 to move freely in a lateral direction within the annular wall 26, as is shown in FIG. 5.

The fixture support apparatus 10 also includes a pedestal 60 having one end forming a stem 61 that is of similar form and dimensions as the swivel stem 24. The pedestal stem 61 includes an annular wall 62 having a plurality of apertures 64 located therethrough. In the preferred embodiment, the annular wall 62 includes four apertures 64. Each aperture 64 is equally spaced from each adjacent aperture 64 and houses a ball bearing 66 therein. A detent 68 spaced inwardly from the annular wall 62 is positioned within the pedestal stem 61 for reciprocating movement along a longitudinal axis of the pedestal 60.

Figure 7:
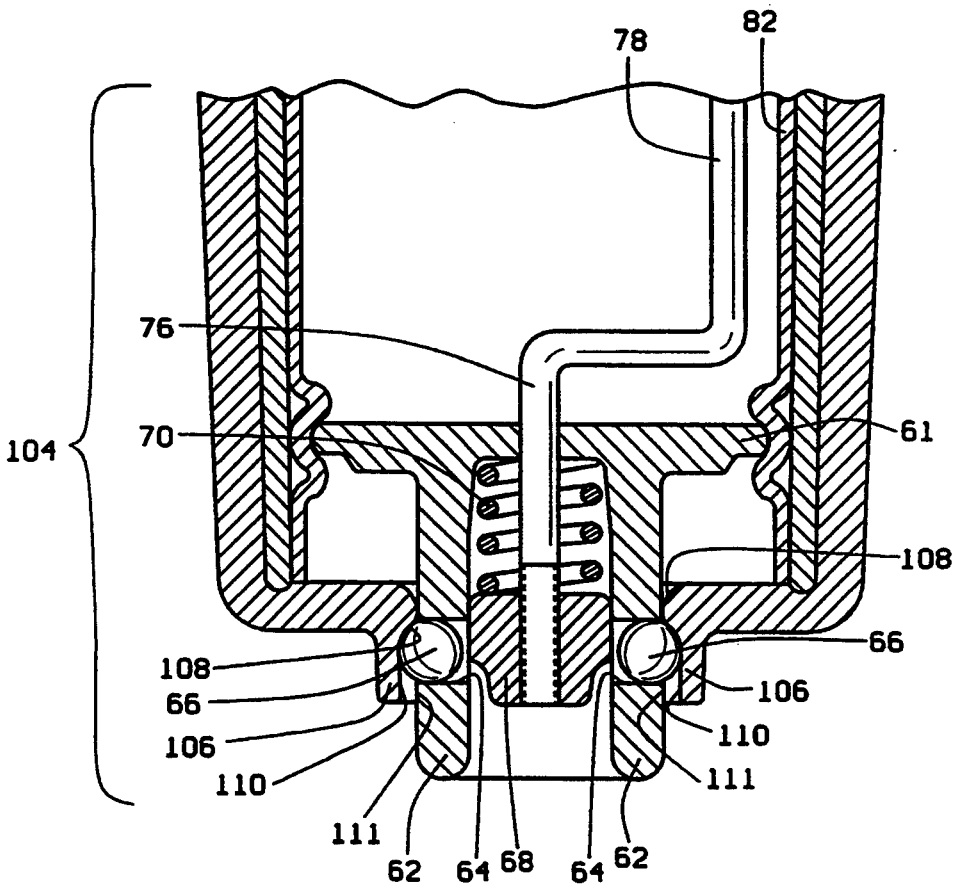
FIG. 7 is an enlarged axial cross-sectional view taken along line 7—7 of FIG. 2 when the hand lever of the pedestal is in its second position.

As can be best seen in FIG. 7, a spring 70 mounted between a shoulder 72 formed in the detent 68 and a shoulder 74 formed in the annular wall 62 biases the detent 68 downwardly toward the ball bearings 66. The detent 68 is connected to one end 76 of a lever arm 78. The opposing end 80 of the lever arm 78 extends through an aperture (not shown) in a wall 82 of the pedestal 60, the aperture permiting the opposing end 80 of the lever arm 78 to be reciprocable in a direction parallel to the longitudinal axis of the pedestal 60. Therefore, the lever arm 78 can be moved between a first position (shown in FIG. 1 in dotted lines) and a second position (shown in FIG. 1 in bold lines).

Under normal operating conditions, the bias of the spring 70 forces the detent 68 into contact with the ball bearings 66, thereby causing the ball bearings 66 to be locked in their outward-most position within the annular wall 62 while forcing the lever arm 78 into its second position. Upon applying adequate pressure to the opposing end 80 of the lever arm 78 to overcome the bias of the spring 70, the lever arm 78 will be moved into its first position. In so doing, the lever arm 78 will transmit a pulling force to the detent 68, moving the detent 68 away from the ball bearings 66. This will enable the ball bearings 66 to move freely in a lateral direction within the annular wall 62.

An opposing end 84 of the pedestal 60 forms a recessed portion 85 for receiving the stem 24 of the swivel 20, the recessed portion 85 including an annular wall 86 having a minimum diameter along an annular lip 88 contained therein. A plurality of annularly spaced scalloped recesses 90 are positioned adjacent to the annular lip 88 along the inner surface of the annular wall 86. The diameter of the annular lip 88 is sufficiently narrow to contact the ball bearings 30 of the swivel 20 and prevent them from passing longitudinally therethrough when the ball bearings 30 are arrested in their outer-most position in the annular wall 26 of the swivel 20, yet sufficiently wide to permit the annular wall 26 of the swivel stem 24 to pass therethrough when the swivel ball bearings 30 are free to move laterally relative to the annular wall 26 of the swivel 20. Similarly, when the annular wall 26 of the swivel 20 is fully seated within the opposing end 84 of the pedestal 60, opposing inner-most edges 92 separating the scalloped recesses 90 from each other create a diameter sufficiently narrow to prevent movement of the swivel ball bearings 30 to adjacent scalloped recesses 90 when the ball bearings 30 are arrested in their outer-most position in the annular wall 26 of the swivel 20, thereby preventing radial movement of the swivel 20. Yet the diameter created by opposing inner-most edges 92 separating the scalloped recesses 90 is sufficiently wide to permit the annular wall 26 of the swivel stem 24 to rotate freely therewithin when the swivel ball bearings 30 are free to move laterally relative to the annular wall 26 of the swivel 20.

The fixture support apparatus 10 additionally includes a base or support anchor 100 having a substantially annular portion 102 surrounding a recessed portion 104 that is of similar form and dimensions as the recessed portion 85 of the opposing end 84 of the pedestal 60. The recessed portion 104 of the support anchor 100 is formed to receive the stem 24 of the swivel 20 and, alternatively, the stem 61 of the pedestal 60. As best shown in FIG. 7, the recessed portion 104 includes an annular wall 106 having a minimum diameter along an annular lip 108 contained therein. A plurality of annularly spaced scalloped recesses 110 are positioned adjacent to the annular lip 108 along the inner surface of the annular wall 106. The diameter of the annular lip 108 is sufficiently narrow to contact the ball bearings 30 of the swivel 20 and, alternatively, the ball bearings 66 of the pedestal 60 and prevent them from passing longitudinally therethrough when the ball bearings 30 and, alternatively, 66 are arrested in their outer-most position in their respective annular walls 26 and, alternatively, 62. Yet the diameter of the annular lip 108 is sufficiently wide to permit the outer-most diameter of annular walls 26 and 62 to pass therethrough when the corresponding ball bearings 30 and 66 are free to move laterally relative to their respective annular walls 26 and 62. Similarly, when the annular walls 26 and 62 are alternately fully seated within the recessed portion 104 of the support anchor 100, opposing inner-most edges 111 separating the scalloped recesses 110 from each other create a diameter sufficiently narrow to prevent movement of the respective ball bearings 30 or 66 to adjacent scalloped recesses 110 when the respective ball bearings 30 or 66 are arrested in their outer-most position in the corresponding annular walls 26 and 62, thereby preventing radial movement of the swivel stem 24 or the pedestal stem 61 associated therewith. Yet the diameter created by opposing inner-most edges 111 separating the scalloped recesses 110 is sufficiently wide to alternatively permit the annular walls 26 and 62 to rotate freely therewithin when the ball bearings 30 or 66 associated therewith are free to move laterally relative to the corresponding annular walls 26 and 62.

It should be noted that in the preferred embodiment there are eight evenly-spaced scalloped recesses 90 in the pedestal stem 61 and eight evenly-spaced scalloped recesses 110 in the support anchor 100. The scalloped recesses 90 of the pedestal 60 can, therefore, receive the four ball bearings 30 of the swivel stem 24 in the variety of arrangements shown in FIG. 6. The scalloped recesses 110 of the support anchor 100 can receive the four ball bearings 30 of the swivel stem 24 and, alternatively, the four ball bearings 66 of the pedestal stem 61 in a similar variety of arrangements.

Figure 2:
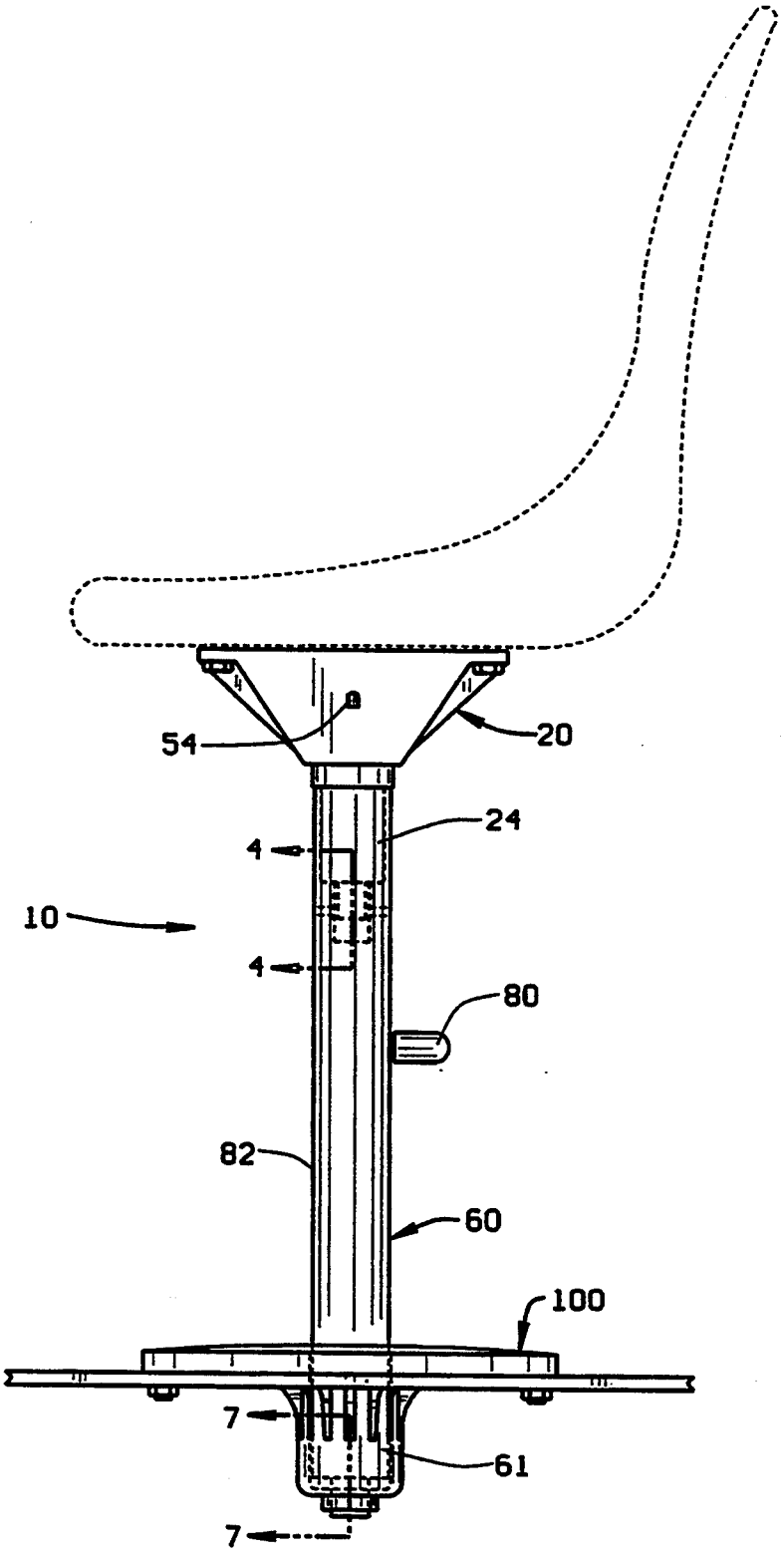
FIG. 2 is a side elevational view of the present invention with the support anchor mounted to a supporting surface and a seat mounted to one end of the swivel.
Figure 3:
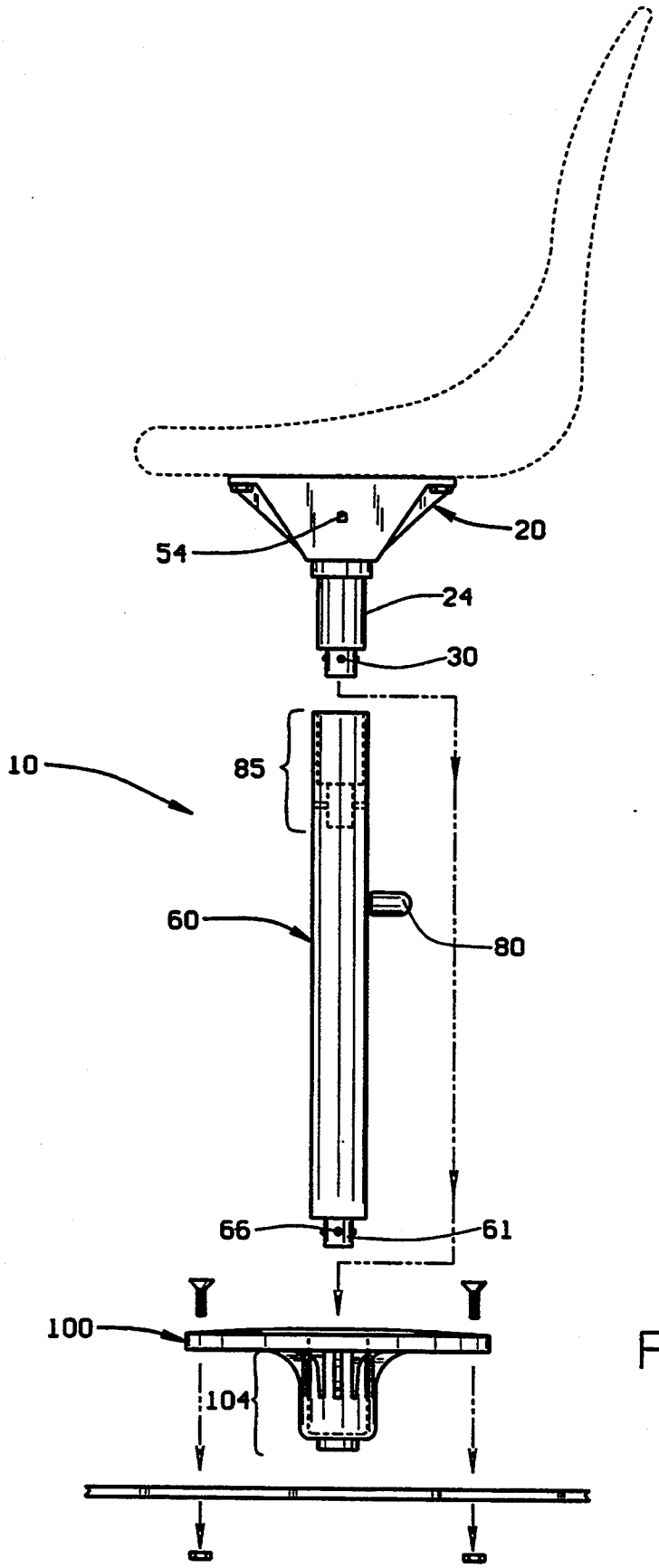
FIG. 3 is an exploded view of FIG. 2.

It should also be noted that the annular portion 102 of the base 100 includes means for receiving the necessary hardware for mounting the support anchor to a support surface, as is shown in FIGS. 2 and 3.

Figure 8:
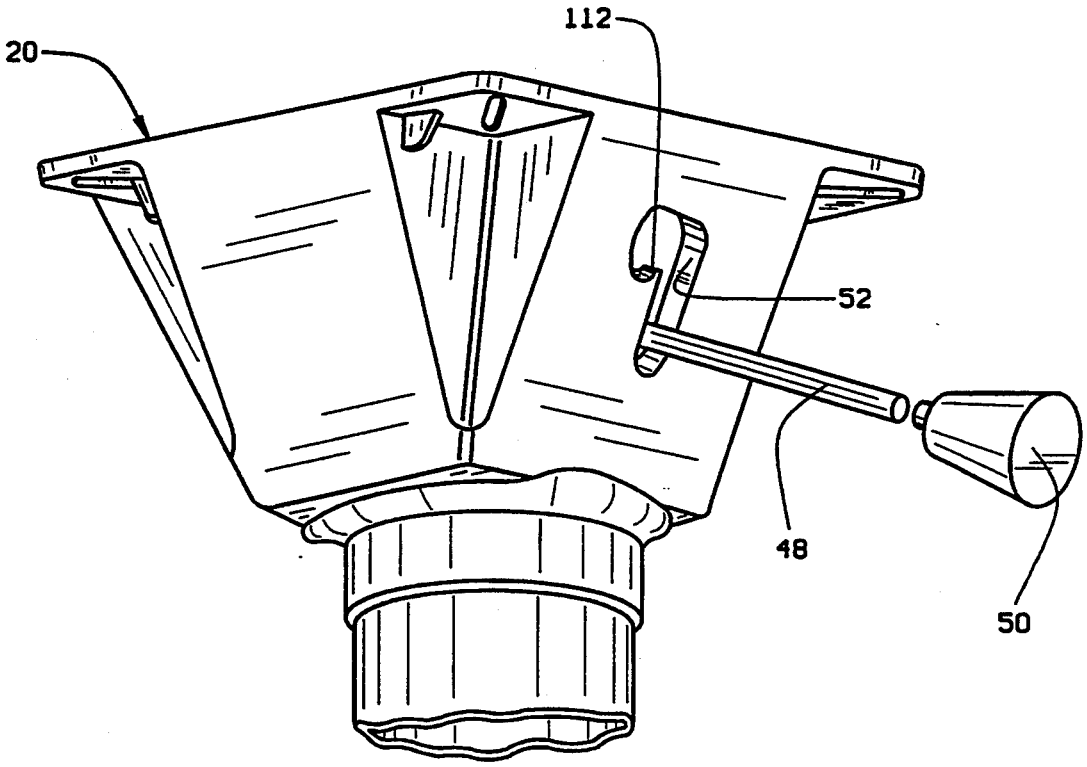
FIG. 8 is a partial perspective view of an alternate embodiment of the swivel including means for retaining the swivel hand lever in its first position.

In an alternative embodiment, the swivel 20 includes a retention lip 112, as shown in FIG. 8, for retaining the lever arm 8 in its first position. The retention lip 112 therefore provides means enabling a fixture to be unobstructedly rotated while relieving users of the burden of maintaining hand pressure to the lever arm 48 of the swivel 20 to counteract the bias of the spring 34.

The most significant utility for this invention is in the manufacture and use of boat seats where high standards of performance must be met to satisfy proposed American Boat and Yacht Council regulations and the boating public. The invention can be used in connection with other types of adjustable seats, tables, particularly tables used in picnic areas, barbecue grills and any other utility where a high performance adjustable support system is desirable.

Thus, there has been shown and described a novel multi-functional fixture support apparatus, which construction fulfills all of the objects and advantages sought therefor. Many changes, modifications, variations and other uses and applications of the present device will, however, become apparent to those skilled in the art after considering this specification and the accompanying drawings. All such changes, modifications, variations and other uses and applications which do not depart from the spirit and scope of the invention are deemed to be covered by the invention which is limited only by the claims which follow.

We claim:

1. An adjustable and transformable fixture support apparatus comprising:

a support anchor mountable to a supporting surface and including stem-retention means associated therewith, a pedestal having opposing first and second pedestal ends, said first pedestal end forming a stem releasably retainable within said stem-retention means of said support anchor, said second pedestal end including stem-retention means, and a swivel having opposing first and second swivel ends, said first swivel end formed to fixedly receive a fixture thereto and said second swivel end forming a stem releasably retainable within said stem-retention means of said second pedestal end and alternatively releasably retainable within said stem-retention means of said support anchor.

2. An adjustable and transformable fixture support apparatus comprising:

a support anchor mountable to a supporting surface, said support anchor including first stem-retention means;

a swivel having opposing first and second swivel ends, said first swivel end formed to enable a fixture to be fixedly attached thereto, said second swivel end forming a stem releasably retainable by said first stem-retention means; and a pedestal having opposing first and second pedestal ends, said first pedestal end forming a stem releasably retainable by said first stem-retention means of said support anchor, said second pedestal end including second stem-retention means for releasably retaining said second swivel end.

3. The apparatus as described in claim 2 wherein said stem of said first pedestal end and said stem of said second swivel end each include means for biasing a respective detent reciprocable between a corresponding first and second position along a detent axis associated therewith and at least one corresponding ball bearing in communication with said respective detent, each said first detent position arresting movement of each corresponding ball bearing in a lateral direction relative to said respective detent axis and each said second detent position permitting each corresponding ball bearing to be laterally yieldable relative to said respective detent axis.

4. The apparatus as described in claim 3 wherein said first stem-retention means include an annular lip through which each ball bearing of said pedestal stem and alternatively each ball bearing of said swivel stem may pass when said respective detent associated therewith is in said second position, each corresponding ball bearing being prevented from passing through said annular lip when said respective detent associated therewith is in said first position.

5. The apparatus of claim 4 wherein said support anchor includes adjusting means for releasably retaining said pedestal stem and alternatively said swivel stem in a plurality of predetermined radial orientations.

6. The apparatus of claim 5 wherein said adjusting means include an annular wall adjacent said annular lip, said annular wall containing a plurality of ball bearing-engaging retention cavities for retainably engaging each ball bearing of said pedestal stem and alternatively each ball bearing of said swivel stem.

7. The apparatus as described in claim 3 wherein said second stem-retention means include an annular lip through which each ball bearing of said swivel stem may pass when said corresponding detent is in said second position, each ball bearing of said swivel being prevented from passing through said annular lip when said associated detent is in said first position.

8. The apparatus of claim 7 wherein said second pedestal end includes adjusting means for releasably retaining said swivel stem in a plurality of predetermined radial orientations.

9. The apparatus of claim 8 wherein said adjusting means include an annular wall adjacent said annular lip, said annular wall containing a plurality of ball bearing-engaging retention cavities for retainably engaging each ball bearing housed in said swivel stem.

10. The apparatus as described in claim 3 wherein said swivel includes means for retaining said detent associated therewith in said second detent position.

11. An adjustable and transformable fixture support apparatus comprising:

a swivel having opposing first and second swivel ends, said first swivel end formed to enable a fixture to be fixedly attached thereto, said second swivel end forming a stem having an axis and including swivel retention means for being releasably retained thereby;

a pedestal having opposing first and second pedestal ends, said first pedestal end forming a stem having an axis and including pedestal retention means for being releasably retained thereby, said second pedestal end including first stem-retention means for cooperatively engaging and releasably retaining said swivel retention means against axial displacement, said second pedestal end further including first adjusting means for releasably retaining said swivel retention means in a plurality of predetermined radial displacements; and a support anchor mountable to a supporting surface and including second stem-retention means for cooperatively engaging and releasably retaining said pedestal retention means and alternatively said swivel retention means against axial displacement, said support anchor further including second adjusting means for releasably retaining said pedestal retention means and alternatively said swivel retention means in a plurality of predetermined radial displacements.

12. The apparatus as described in claim 11 wherein a boat seat is fixedly attached to the first swivel end.

* * * * *